United States Patent [19]

Hong

[11] Patent Number: 4,627,681

[45] Date of Patent: Dec. 9, 1986

[54] LOCKING ELECTRICAL CONNECTOR

[76] Inventor: Douglas Hong, 12106 Rustic Hill Dr., Bowie, Md. 20715

[21] Appl. No.: 702,270

[22] Filed: Feb. 15, 1985

[51] Int. Cl.[4] ..... H01R 13/631

[52] U.S. Cl. ..... 339/75 P; 339/75 M

[58] Field of Search ..... 339/75 P, 75 M, 75 MP, 339/74 R

[56] References Cited

U.S. PATENT DOCUMENTS

| | | | |
|---|---|---|---|
| 3,891,289 | 6/1975 | Hanke | 339/75 P |
| 4,080,032 | 3/1978 | Cherian et al. | 339/75 M |
| 4,178,053 | 12/1979 | Eifort | 339/75 MP |
| 4,314,736 | 2/1982 | Demnianiuk | 339/75 M |
| 4,391,408 | 7/1983 | Hanlon et al. | 339/75 M |

*Primary Examiner*—John McQuade

*Attorney, Agent, or Firm*—Dennis H. Lambert

[57] ABSTRACT

A locking electrical connector in which male contacts (22) and female contacts (17,18) are adapted to be locked together in coupled relationship. The female contacts comprise resiliently movable legs (19,20) for receiving the male contact (22) therebetween, and a movable wedging member (24) is provided for pressing the legs against the male contact to lock it in coupled position. In one form of the invention, the wedging member (24) is selectively manually movable into and out of wedging contact with the female members, and in another form the wedging member (64) is automatically moved into wedging or locking position upon insertion of the male member into the female contact.

3 Claims, 25 Drawing Figures

LOCKING ELECTRICAL CONNECTOR

FIELD OF THE INVENTION

This invention relates to electrical connectors, and more particularly, to electrical connectors of the cord type such as extension cords, appliance cords, etc.

Electrical appliances and tools are used today for many purposes, from cleaning and cooking to outdoor tasks. The appliances and tools derive their power from electrical outlets, to which the appliances are connected via electrical cords. The cords typically comprise a male member carried by the appliance or tool and a female member associated with a wall outlet or another cord, such as an extension cord. In use, the connection between the male member and the female member frequently becomes loose, either because of force applied thereto or because the members become loose-fitting over a period of time. This occurrence is a nuisance at best, and may produce a hazardous condition, depending upon the nature of the tool or appliance and its use.

PRIOR ART

In order to prevent the male and female electrical connectors from becoming disengaged, the adjacent ends of the cords are sometimes tied together. While this solution does prevent disconnection of the male and female coupling halves, it does not insure any better electrical connection than is capable of being provided by the electrical contacts in the coupling halves. Moreover, it is time consuming and requires the use of both hands. Further, this solution to the problem cannot be used when the cord is plugged into a wall outlet. Another solution which is sometimes used to solve the problem is to make the male and female coupling halves very tight-fitting so that their accidental disengagement is unlikely. However, this has the disadvantage that the parts are difficult to couple and uncouple, rendering their use unsuitable for people with disabilities, such as individuals afflicted with arthritis, weakened with old age, etc. Moreover, damage to other components may result from the excessive force required to uncouple such electrical connectors.

Still other devices have been specially designed to lock electrical connectors together after they have been coupled, preventing their accidental uncoupling. Such devices are described in U.S. Pat. Nos. 3,543,218 and 3,710,304, for example. In U.S. Pat. No. 3,543,218, the locking action is achieved through the use of interengaged pins and holes on the male and female coupling halves. In order to disengage the connector, the parts must be manipulated to release the pin from the hole. This procedure may require a trial-and-error approach, and if damage to the contacts occurs through use it may not be possible to disengage the pin from the hole without breaking the connector. In U.S. Pat. No. 3,710,304, an over-center wedging member is arranged to press against the contacts of the female member, urging them into frictional locking engagement with the male prong. The contacts are released by urging the over-center member in the opposite direction. The rod and toggle arrangement used in this patent is relatively fragile and expensive.

DISCLOSURE OF THE INVENTION

In accordance with the present invention, an electrical connector has a wedging member which is movable into and out of locking positions to selectively lock and unlock the male and female electrical contacts from one another. The wedging member comprises a rod or bar which has camming surfaces thereon adapted to engage the female contacts and urge them into gripping engagement with the male contact. The wedging member is simple, economical and rugged in construction, and not only prevents accidental uncoupling of the contacts but also insures positive electrical contact between the coupling halves. Moreover, the invention enables the contacts to be initially relatively loose fitting, whereby they are easier to couple and uncouple, facilitating their use by all persons.

In one form of the invention, the wedging member is selectively manually operated to lock and unlock the electrical contacts, and in another form, the wedging member is automatically operated upon insertion of the male member into the female member.

BRIEF DESCRIPTION OF THE DRAWINGS

Details of the invention will be described in connection with the accompanying drawings, in which.

BEST MODE FOR CARRYING OUT THE INVENTION

Figure 8:
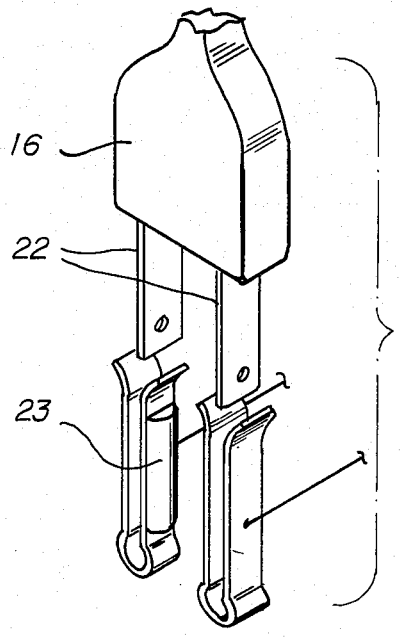
FIG. 8 is an exploded, perspective schematic view of the female and male electrical contacts, showing the guide surfaces on the female contacts.

The electrical connector 10 in accordance with a first form of the invention comprises the female receptacle or socket end 11 of an extension cord 12 or the like. In the form of the invention shown, the connector is of the type having multiple sockets 13, 14, 15 for simultaneously receiving a plurality of male connector halves or plugs, such as shown at 16 in FIG. 8.

Figure 9:
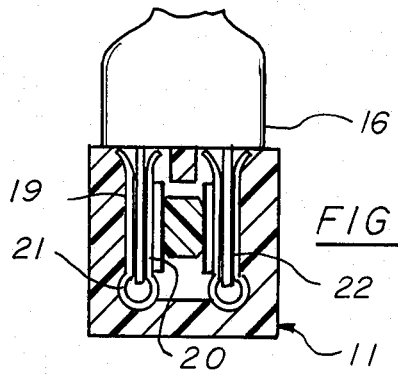
FIG. 9 is an enlarged sectional view showing the relationship of the male and female contacts and wedging member when in the locked position.
Figure 10:
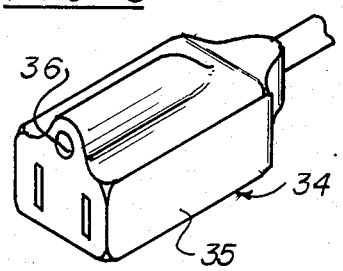
FIG. 10 is a perspective view of a second form of the invention.
Figure 11:
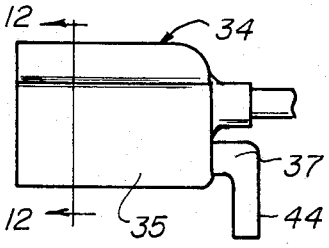
FIG. 11 is a side view in elevation of the second form of the invention.
Figure 12:
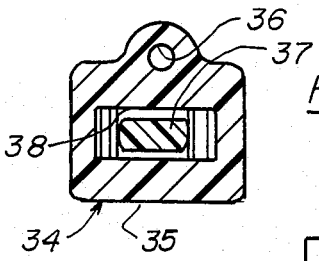
FIG. 12 is a transverse sectional view taken along line 12—12 in FIG. 11.

The sockets 13, 14 and 15 are of essentially conventional construction, each comprising a pair of generally U-shaped contacts 17 and 18. The contacts have a pair of spaced apart legs 19 and 20 joined by a bight portion 21. As seen best in FIG. 9, one of the legs 19 and the bight portion 21 are typically fixed in the material of the housing of the connector and the other leg 20 is resiliently yieldable or spring biased toward the leg 19. The free ends of the legs are flared outwardly to facilitate the entry of the blade 22 of the male plug therebetween. In conventional contstructions, the bias of the legs toward one another is relied upon to hold the blade 22 of the male plug inserted therebetween.

Figure 1:
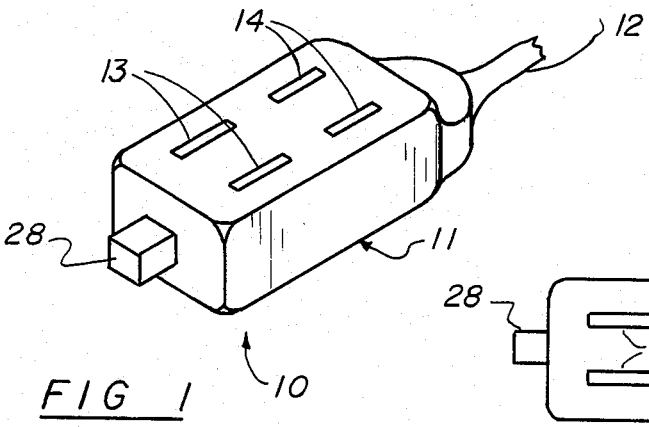
FIG. 1 is a perspective view of a female electrical connector or socket incorporating one form of the invention therein.
Figure 2:
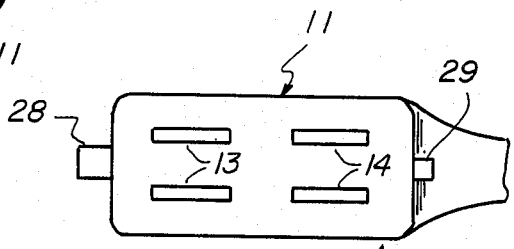
FIG. 2 is a top plan view of the connector of FIG. 1.
Figure 3:
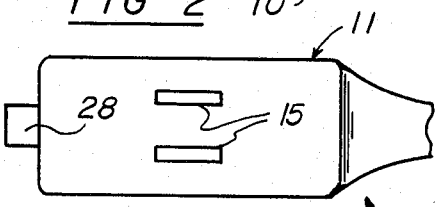
FIG. 3 is a bottom plan view of the connector of FIG. 1.
Figure 5:
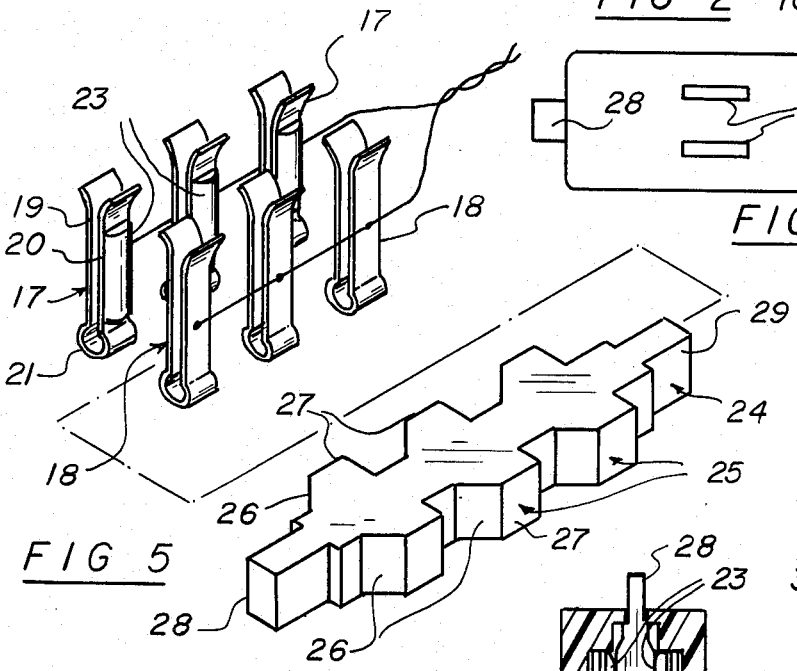
FIG. 5 is an exploded, schematic view showing the female contact members and the wedging member of the invention.
Figure 4:
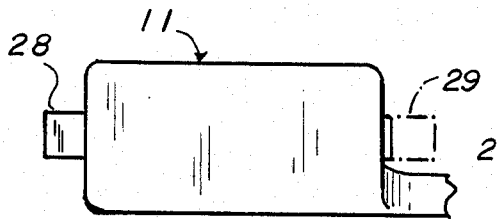
FIG. 4 is a side view in elevation of the connector of FIG. 1.
Figure 6:
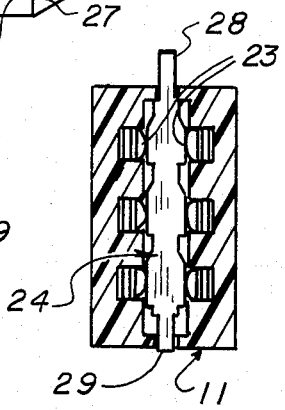
FIGS. 6 and 7 are schematic plan views of the apparatus in FIG. 5, showing the wedging member in locked and unlocked positions, respectively.
Figure 7:
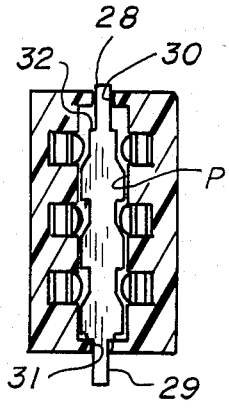

In accordance with the invention, however, the resiliently movable leg 20 of each contact has a rounded surface or cam guide 23 formed thereon, as by solder or the like, for cooperation with a wedge member 24 having a plurality of camming surfaces 25 along its length. The wedge member is longitudinally slidable in an elongate bore or passagge P extending longitudinally through the body 11, as seen best in FIGS. 6 and 7. As seen best in FIGS. 5, 6 and 7, the camming surfaces each comprise a sloping ramp 26 and a flat or land 27. The opposite ends 28 and 29 of the wedging member extend into guide openings 30 and 31 in the opposite ends of the connector housing and, depending upon whether the wedging member is in a "locked" position (FIG. 6) or an "unlocked" position (FIG. 7), one of the ends 28 or 29 projects outwardly of the housing where it can be contacted with the finger of the user to move it in the opposite direction. Thus, with the wedging member in an unlocked position as shown in FIG. 7, the blades 22 of one or more male plugs can be inserted into the respective female contacts or sockets 13, 14 and 15. This insertion can be accomplished with relative ease, since the only resistance will be the spring bias of the legs 19 and 20 toward one another. However, after the blades have been inserted into the contacts, the end 29 of the wedging member 24 can be engaged with the finger of the user or pushed against a surface such as the wall or floor to move the ramps 26 against the guides 23 and force the leg 20 toward leg 19 and into tight, clamping relationship on the blade 22 inserted therebetween. The male and female electrical connector portions thereby resist disengagement. At the same time, a strong electrical contact is established between the blade 22 and legs 19 and 20. Further, although the lands 27 on the camming surfaces have an adequate length to insure full engagement with all of the cam guides 23, a stop 32 is formed on the wedging member to engage against the end of the connector housing and prevent movement of the wedging member beyond a desired point.

Figure 13:
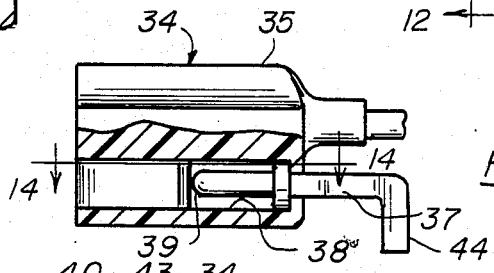
FIG. 13 is a side elevational view, with a portion shown in section, of the device of FIG. 12, showing the wedging member in unlocked position.
Figure 14:
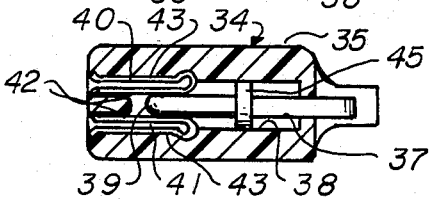
FIG. 14 is a transverse sectional view taken along line 14—14 in FIG. 13.
Figure 15:
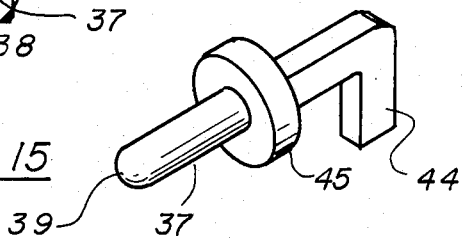
FIG. 15 is a perspective view of the wedging member of FIGS. 10–14.

A second form of the invention is shown at 34 in FIGS. 10 through 15. In this form of the invention, the receptacle 35 is of the "grounded" type in that it has a socket 36 for receiving a grounding contact (not shown) on a cooperating male plug member (not shown). The receptacle 35 is of essentially conventional construction, except that a wedge member 37 is reciprocable in a guide opening 38 in the housing of the receptacle. The wedge member has a rounded nose portion or camming member 39 which is adapted to be extended into the space between the facing contacts of the female sockets 40 and 41, engaging the legs 42 and forcing them toward the legs 43 into tight contact with the blades (not shown) of a male connector inserted therebetween. As seen best in FIGS. 11, 14 and 15, the wedge member has an actuator portion 44 which extends outwardly of the housing so that it may be grasped with the fingers of the user to manipulate the camming member 39 relative to the female contacts. A stop 45 is formed on the wedge member between its ends for cooperation with the housing to limit movement of the wedge member as shown in FIGS. 13 and 14.

Figure 16:
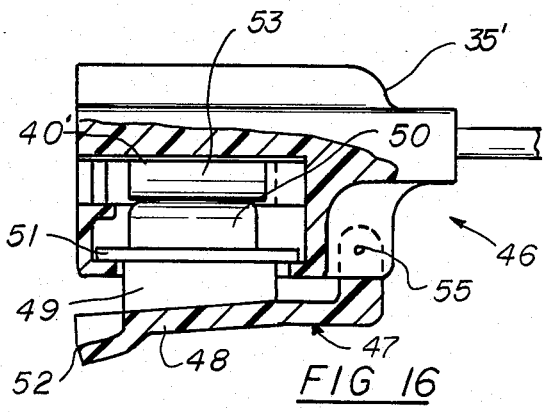
FIG. 16 is a side view, shown partly in section, of a third form of the invention.
Figure 17:
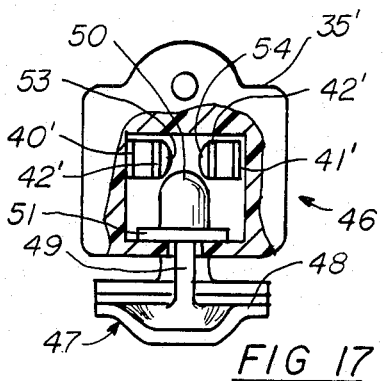
FIG. 17 is an end view of the device of FIG. 16, with a portion thereof shown in section.
Figure 18:
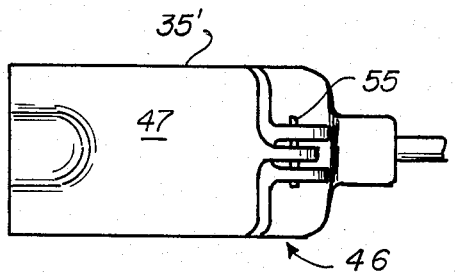
FIG. 18 is a bottom plan view of the connector of FIGS. 16 and 17.
Figure 20:
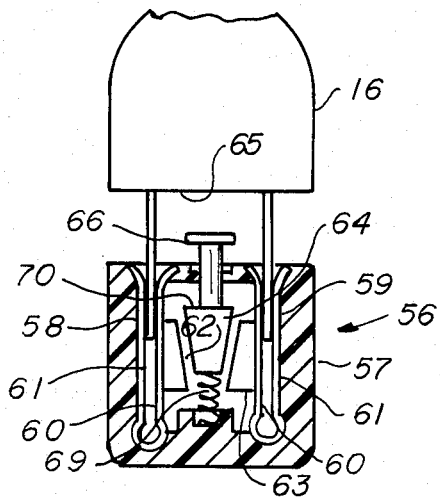
FIG. 20 is a horizontal sectional view of the connector of FIG. 19, showing the parts in unlocked position.
Figure 19:
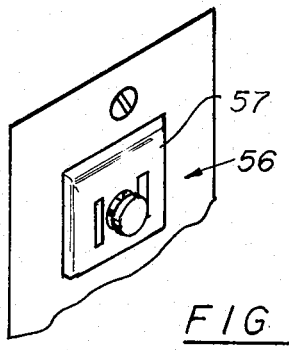
FIG. 19 is a perspective view of a fourth form of the invention, wherein the wedging member is incorporated in a wall outlet.
Figure 21:
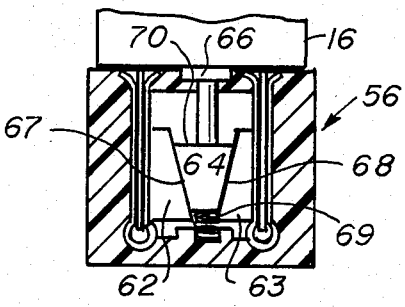
FIG. 21 is a view similar to FIG. 20, showing the parts in locked position.
Figure 22:
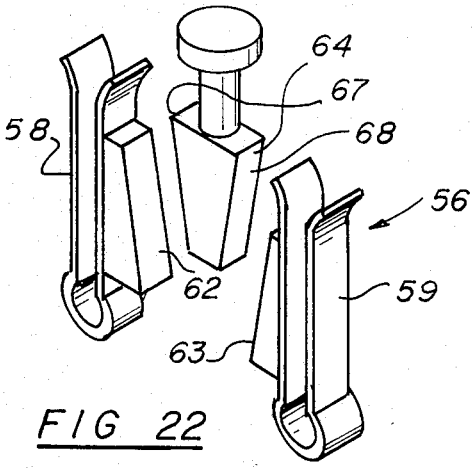
FIG. 22 is an exploded, perspective view of the wedging member and associated structure on the female contacts.

A third form of the invention is shown at 46 in FIGS. 16 through 18. This form of the invention also comprises a grounded type connector or receptacle 35'. However, rather than the reciprocable wedge member of FIGS. 10–15, a pivoted wedge member 47 is connected with the housing for swinging or pivotal movement into and out of contact with the sockets 40' and 41'. The wedge member 47 has a generally flat body 48 with an upwardly projecting wedge or blade 49 extending into the receptacle. The blade has a rounded nose portion 50 to facilitate entry of the blade between the legs 42' of the sockets, and a stop 51 to limit outward movement of the wedge member 47 when it is moved to an "unlocked" position (FIG. 16). The body 48 has a raised portion 52 on its forward edge to facilitate gripping of the wedge member and movement of it to the unlocked position. Moreover, the legs 42' of the sockets 40' and 41' have rounded surfaces 53 and 54 thereon for cooperation with the rounded nose 50 of the wedge member during initial movement of the wedge member into the space between the legs 42'. While the wedge member 47 is shown as connected to the body of the receptacle 35' by a pin arrangement 55, it could also be attached by an integrally molded hinge section (not shown).

A fourth form of the invention is shown in FIGS. 19 through 22 at 56. In this form of the invention, the receptacle comprises a wall socket 57 with a pair of female electrical contacts 58 and 59. The legs 60 of the contacts have inclined ramps or cam surfaces 62 and 63 formed thereon, defining a decreasing space toward the inner end of the contacts. A wedge member 64 is reciprocably mounted in the receptacle 56, and is spring-biased in an outward direction, spaced slightly from the cam surfaces 62 and 63. When a male electrical plug 16 is inserted into the receptacle 56, the face 65 of the plug engages the outwardly projecting end or actuator 66 of the wedge member 64, forcing it inwardly and bringing the oppositely inclined camming surfaces 67, 68 thereon into contact with the cam surfaces 62 and 63 on the legs of the female contacts, pressing them tighty against the prongs of the male plug and preventing accidental displacement of the plug from the receptacle. When the plug is removed from the receptacle, the spring 69 associated with the wedge member urges the wedge member outwardly, releasing the prongs from the sockets. Outward movement of the wedge member is limited by the shoulder 70 formed on the wedge member between the actuator 66 and camming surfaces 67, 68.

Figure 23:
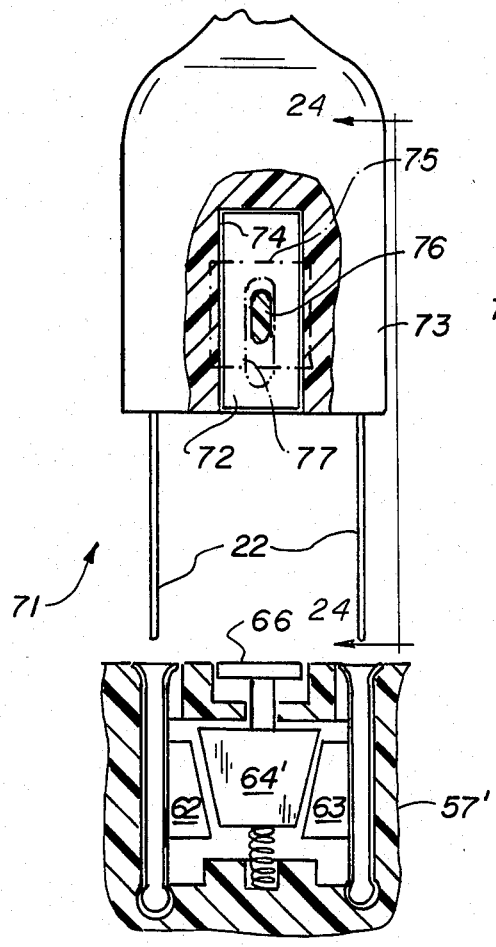
FIG. 23 is an exploded view, with parts shown in section, of a fifth form of the invention, wherein a wedging member similar to that shown in FIG. 20 is operated by a selectively manually operable actuator in the male connector part.
Figure 24:
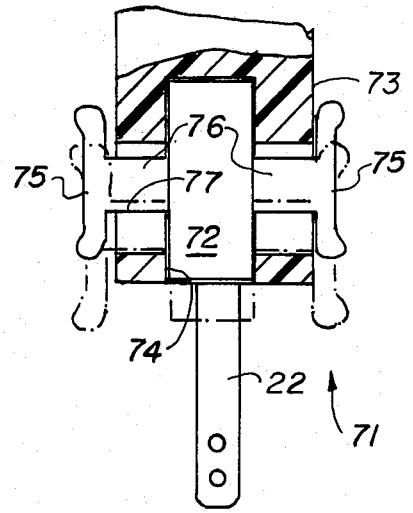
FIG. 24 is a fragmentary sectional view taken along line 24—24 in FIG. 23.
Figure 25:
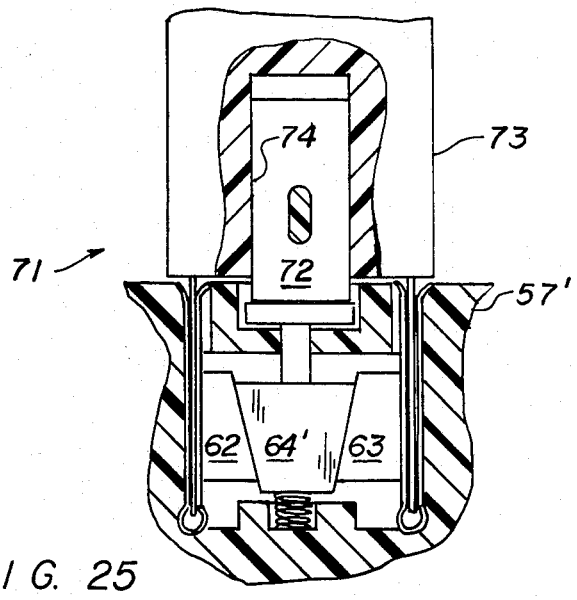
FIG. 25 is a view similar to FIG. 23, showing the parts coupled together and the wedging member extended to lock the parts together.

A fifth form of the invention is shown at 71 in FIGS. 23 through 25. In this form of the invention, The receptacle 57' is identical in every respect to that described in connection with the fourth form of the invention, except that the actuator 66 for the wedge member 64' is recessed so that its outer end is flush with the outer surface of the receptacle. The wedge member 64' is moved into engagement with the cam surfaces 62 and 63 by an actuator pin 72 carried by the male plug 73. The actuator pin 72 is guided in an opening 74 between the prongs 22 of the male plug and has a slide or finger button 75 on the upper end of a stem 76 projecting through a slot 77 in the body of the plug. Thus, the plug may be easily inserted into the receptacle and the actuator 72 thereafter moved forwardly to push the wedge member 64' inwardly to contact the cam surfaces 62 and 63 and force the legs of the female contacts inwardly against the blade or prongs of the male plug. When it is desired to remove the plug, the actuator is simply moved in the reverse direction, freeing the blades or prongs from the female contacts.

I claim:

1. A locking, multiple socket female electrical connector for extension cords, appliances and the like, comprising:

an elongate body of electrically non-conductive material having a longitudinally extending passage therethrough defined by spaced apart side walls, said body having inwardly projecting shoulders formed thereon at opposite ends of the passage, defining stops around reduced diameter guide openings at the opposite ends of the passage;

a plurality of generally U-shaped female contacts carried by the body on opposite sides of the passage and spaced uniformly apart along the length of the passage, said contacts each comprising a pair of spaced apart legs joined at one end by a bight portion and being inherently resiliently biased to said spaced apart position, a first leg and the bight portion of each contact being fixed in the material of the body and the second leg of each contact being disposed substantially in the plane of the passage side wall, each said second leg having a rounded cam guide surface formed thereon on the side toward the passage, said cam guide surface extending throughout substantially the entire length of the leg; and an elongate, one-piece wedge member longitudinally slidable in said passage, said wedge member having a cross-sectional dimension less than the cross-sectional dimension of the passage, and having a plurality of inclined cam surfaces on opposite sides thereof, each terminating at one end in a recessed portion of the wedge member and terminating at the other end in a generally flat wedging surface disposed closely adjacent and parallel to the side wall of the passage in a position to engage the cam guide surfaces on said second legs of the contacts and urge said second legs toward the first legs of each contact, said wedge member having opposite end portions projecting through the reduced diameter guide openings, defining combination guides and actuators extending beyond the end of the body, the length of the wedge member, including the actuators, being such that when the actuator at one end of the wedge member projects from the body, the actuator at the other end of the wedge member is substantially flush with the end of the body, said wedge member having stop surfaces formed at the inner or base ends of the actuators for engaging the stops formed in the body to limit axial movement of the wedge member so that when the wedge member is in an unlocked position the recesses thereof are in registry with said contacts so that the legs of the contacts are in their at-rest spaced apart position, and when the wedge member is in a locked position the wedging surfaces thereon are in engagement with the cam guide surfaces on said second legs, urging the second legs toward the first legs for securely gripping a male electrical contact when inserted between the legs of the female contact.

2. An electrical connector as claimed in claim 1, wherein:

the other ends of the first and second legs of the contacts extend to the surface of the body and define an opening for receiving a male contact member; and adjacent pairs of said contacts are oriented to open alternately on opposite sides of said body.

3. An electrical connector as claimed in claim 2, wherein:

said body comprises the receptacle end of an extension cord.

* * * * *